US012285046B2

(12) United States Patent
Valentine et al.

(10) Patent No.: US 12,285,046 B2
(45) Date of Patent: Apr. 29, 2025

(54) CARTRIDGES FOR VAPORIZER DEVICES

(71) Applicant: JUUL Labs, Inc., San Francisco, CA (US)

(72) Inventors: Val Valentine, San Francisco, CA (US); Qingcheng Zeng, San Jose, CA (US)

(73) Assignee: JUUL Labs, Inc., Washington, DC (US)

( * ) Notice: Subject to any disclaimer, the term of this patent is extended or adjusted under 35 U.S.C. 154(b) by 645 days.

(21) Appl. No.: 17/485,622

(22) Filed: Sep. 27, 2021

(65) Prior Publication Data

US 2022/0007722 A1 Jan. 13, 2022

Related U.S. Application Data

(63) Continuation of application No. PCT/US2020/025336, filed on Mar. 27, 2020.
(Continued)

(51) Int. Cl.

| | |
|---|---|
| ***A24F 40/10*** | (2020.01) |
| ***A24F 40/42*** | (2020.01) |
| ***A24F 40/44*** | (2020.01) |
| ***A24F 40/46*** | (2020.01) |
| ***A24F 40/48*** | (2020.01) |
| ***A24F 40/51*** | (2020.01) |

(52) U.S. Cl.
CPC ..... *A24F 40/42* (2020.01); *A24F 40/46* (2020.01)

(58) Field of Classification Search
None
See application file for complete search history.

(56) References Cited

U.S. PATENT DOCUMENTS 4,303,083 A 12/1981 Burruss, Jr.
4,794,323 A 12/1988 Zhou et al.
(Continued)

FOREIGN PATENT DOCUMENTS

AT 507187 B1 3/2010
CA 2469408 C 1/2014
(Continued)

OTHER PUBLICATIONS

CN205512338U English Translation obtained from Espacenet, pp. 1-6 (Year: 2016).*
(Continued)

*Primary Examiner* — Philip Y Louie
*Assistant Examiner* — Madeleine P Delacruz
(74) *Attorney, Agent, or Firm* — Mintz, Levin, Cohn, Ferris, Glovsky and Popeo, P.C.

(57) ABSTRACT

Cartridges for vaporizer devices are provided. In one exemplary embodiment, a cartridge can include a reservoir housing that includes a reservoir chamber configured to selectively hold a vaporizable material, and an atomizer in fluid communication with the reservoir chamber. The atomizer includes a substrate having an array of ordered pores configured to draw a predetermined volume of vaporizable material from the reservoir chamber at a predetermined rate, and at least one heating material configured to selectively heat the at least a portion of the vaporizable material drawn into the substrate to generate a vaporized material. Vaporizer devices are also provided.

20 Claims, 5 Drawing Sheets

Related U.S. Application Data

(60) Provisional application No. 62/826,049, filed on Mar. 29, 2019.

(56) References Cited

U.S. PATENT DOCUMENTS 4,797,692 A 1/1989 Ims
5,865,186 A 2/1999 Volsey et al.
6,095,153 A 8/2000 Kessler et al.
6,196,218 B1 3/2001 Voges
6,322,268 B1 11/2001 Kaufmann et al.
6,516,796 B1 2/2003 Cox et al.
6,909,840 B2 6/2005 Harwig et al.
7,290,549 B2 11/2007 Banerjee et al.
7,367,334 B2 5/2008 Faison, Jr. et al.
7,434,584 B2 10/2008 Steinberg
7,793,860 B2 9/2010 Bankers et al.
7,793,861 B2 9/2010 Bankers et al.
8,550,069 B2 10/2013 Alelov
8,752,545 B2 6/2014 Buchberger
8,833,364 B2 9/2014 Buchberger
8,948,578 B2 2/2015 Buchberger
9,016,274 B1 4/2015 White
9,247,773 B2 2/2016 Memari et al.
9,254,007 B2 2/2016 Liu
9,272,103 B2 3/2016 Storz
9,420,829 B2 8/2016 Thorens et al.
9,572,374 B2 2/2017 Gabbay
9,623,205 B2 4/2017 Buchberger
9,642,397 B2 5/2017 Dai et al.
9,682,203 B2 6/2017 Dahne et al.
9,687,027 B2 6/2017 Poston et al.
9,687,028 B2 6/2017 Park
9,772,216 B2 9/2017 Poole et al.
9,943,108 B2 4/2018 Lord
10,045,568 B2 8/2018 Monsees et al.
10,058,129 B2 8/2018 Monsees et al.
10,058,130 B2 8/2018 Monsees et al.
10,070,668 B2 9/2018 Li et al.
10,070,669 B2 9/2018 Monsees et al.
10,076,139 B2 9/2018 Monsees et al.
10,085,485 B2 10/2018 Hunt et al.
10,104,915 B2 10/2018 Bowen et al.
10,111,470 B2 10/2018 Monsees et al.
10,117,465 B2 11/2018 Monsees et al.
10,117,466 B2 11/2018 Monsees et al.
10,159,282 B2 12/2018 Monsees et al.
10,188,148 B2 1/2019 Althorpe et al.
10,194,693 B2 2/2019 Wensley et al.
10,201,190 B2 2/2019 Monsees et al.
10,278,421 B2 5/2019 Lord
10,285,450 B2 5/2019 Gavrielov et al.
10,292,436 B2 5/2019 Cirillo et al.
10,314,340 B2 6/2019 Davis et al.
2003/0215335 A1 11/2003 Crivelli
2004/0151598 A1 8/2004 Vapore
2005/0268911 A1 12/2005 Cross et al.
2009/0032034 A1 2/2009 Steinberg
2009/0126746 A1 5/2009 Strickland et al.
2009/0293892 A1 12/2009 Williams et al.
2009/0324206 A1 12/2009 Young et al.
2012/0111346 A1 5/2012 Rinker et al.
2013/0180533 A1 7/2013 Kim et al.
2013/0306065 A1 11/2013 Thorens et al.
2014/0041655 A1 2/2014 Barron et al.
2014/0060554 A1 3/2014 Collett et al.
2014/0109921 A1 4/2014 Chen
2014/0123989 A1 5/2014 LaMothe
2014/0150783 A1 6/2014 Liu
2014/0261487 A1 9/2014 Chapman et al.
2014/0261490 A1 9/2014 Kane
2014/0261492 A1 9/2014 Kane et al.
2014/0290676 A1 10/2014 Liu
2015/0059780 A1 3/2015 Davis et al.
2015/0173419 A1* 6/2015 Tu ..... A24F 40/51 131/329
2015/0216237 A1 8/2015 Wensley et al.
2015/0245654 A1 9/2015 Memari et al.
2015/0245655 A1 9/2015 Memari et al.
2015/0245657 A1 9/2015 Memari et al.
2015/0245662 A1 9/2015 Memari et al.
2015/0245665 A1 9/2015 Memari et al.
2015/0245666 A1 9/2015 Memari et al.
2015/0245667 A1 9/2015 Memari et al.
2015/0245668 A1 9/2015 Memari et al.
2016/0007653 A1 1/2016 Tu
2016/0073694 A1 3/2016 Liu
2016/0143354 A1 5/2016 Liu
2016/0150824 A1 6/2016 Memari et al.
2016/0262454 A1 9/2016 Sears et al.
2016/0278163 A1 9/2016 Chen
2016/0286865 A1 10/2016 King et al.
2016/0295913 A1 10/2016 Guo et al.
2016/0309783 A1 10/2016 Hopps et al.
2016/0309785 A1 10/2016 Holtz
2016/0309786 A1* 10/2016 Holtz ..... H05B 3/16
2016/0331033 A1 11/2016 Hopps et al.
2016/0331913 A1 11/2016 Bourque
2016/0353805 A1 12/2016 Hawes et al.
2017/0006920 A1 1/2017 Liu
2017/0013882 A1 1/2017 Liu
2017/0030882 A1 2/2017 Skoda
2017/0042242 A1 2/2017 Hon
2017/0049152 A1 2/2017 Liu
2017/0071253 A1 3/2017 Revell
2017/0105455 A1 4/2017 Qiu
2017/0108210 A1 4/2017 Meinhart et al.
2017/0127725 A1 5/2017 Buchberger et al.
2017/0143038 A1 5/2017 Dickens
2017/0188629 A1 7/2017 Dickens et al.
2017/0208857 A1 7/2017 Branton et al.
2017/0219391 A1 8/2017 Lin et al.
2017/0231276 A1 8/2017 Mironov et al.
2017/0231277 A1 8/2017 Mironov et al.
2017/0231278 A1 8/2017 Mironov et al.
2017/0231279 A1 8/2017 Watson
2017/0231286 A1 8/2017 Borkovec et al.
2017/0258134 A1 9/2017 Kane
2017/0273360 A1 9/2017 Brinkley et al.
2017/0280771 A1 10/2017 Courbat et al.
2017/0318860 A1 11/2017 Adair
2017/0333650 A1 11/2017 Buchberger et al.
2017/0354184 A1 12/2017 Mironov et al.
2017/0367402 A1 12/2017 Lau et al.
2017/0367407 A1 12/2017 Althorpe et al.
2018/0020728 A1 1/2018 Alarcon et al.
2018/0098572 A1* 4/2018 Minskoff ..... A24F 40/46
2018/0132532 A1 5/2018 Batista
2018/0153219 A1 6/2018 Verleur et al.
2018/0153220 A1 6/2018 Verleur et al.
2018/0160722 A1 6/2018 Verleur et al.
2018/0161525 A1 6/2018 Liu et al.
2018/0162769 A1 6/2018 Peuchert et al.
2018/0199627 A1 7/2018 Bowen et al.
2018/0317557 A1 11/2018 Monsees et al.
2018/0343925 A1* 12/2018 Wensley ..... F04B 19/00
2019/0001077 A1 1/2019 Xu et al.
2019/0150520 A1 5/2019 Fraser et al.
2019/0166913 A1 6/2019 Trzecieski
2019/0350256 A1 11/2019 Hejazi
2019/0373953 A1 12/2019 Atkins et al.
2020/0000151 A1 1/2020 Fraser et al.
2020/0107585 A1 4/2020 Atkins et al.
2020/0113245 A1 4/2020 Rosser et al.
2020/0114094 A1 4/2020 Atkins et al.
2020/0128874 A1 4/2020 Atkins et al.
2020/0275696 A1 9/2020 Atkins et al.

FOREIGN PATENT DOCUMENTS

CN 101213402 A 7/2008
CN 103180053 A 6/2013
CN 203234036 U 10/2013
CN 203952435 U 11/2014
CN 204579893 U 8/2015

(56) References Cited

FOREIGN PATENT DOCUMENTS

| | | | | | |
|---|---|---|---|---|---|
| CN | 204994615 | U | | 1/2016 | |
| CN | 205512338 | U | * | 8/2016 | |
| CN | 205962844 | U | | 2/2017 | |
| CN | 107411172 | A | | 12/2017 | |
| CN | 206821974 | U | | 1/2018 | |
| CN | 207011686 | U | | 2/2018 | |
| CN | 105188428 | B | | 6/2018 | |
| CN | 104983076 | B | | 7/2018 | |
| CN | 108430242 | A | | 8/2018 | |
| CN | 208113970 | U | | 11/2018 | |
| CN | 105394816 | B | | 12/2018 | |
| CN | 109222235 | A | * | 1/2019 | ..... A24B 15/167 |
| CN | 109222243 | A | * | 1/2019 | ..... A24F 47/008 |
| CN | 109310157 | A | | 2/2019 | |
| CN | 105919164 | B | | 3/2019 | |
| CN | 109475186 | A | | 3/2019 | |
| CN | 110226778 | A | | 9/2019 | |
| CN | 107889450 | B | | 8/2020 | |
| CN | 113015448 | A | | 6/2021 | |
| DE | 102014106589 | A1 | | 11/2015 | |
| DE | 102017123869 | B4 | | 5/2019 | |
| DE | 102017123870 | B4 | | 5/2019 | |
| EP | 2544743 | B1 | | 1/2014 | |
| EP | 2709476 | B1 | | 9/2016 | |
| EP | 3130238 | A1 | | 2/2017 | |
| EP | 3135139 | A1 | | 3/2017 | |
| EP | 3165102 | A2 | | 5/2017 | |
| EP | 2950675 | B1 | | 10/2017 | |
| EP | 3130238 | B1 | | 5/2018 | |
| EP | 3423058 | A1 | | 1/2019 | |
| EP | 3435794 | B1 | | 9/2020 | |
| EP | 3518696 | B1 | | 11/2020 | |
| EP | 3487564 | B1 | | 1/2021 | |
| EP | 3528625 | B1 | | 1/2021 | |
| EP | 3547855 | B1 | | 1/2021 | |
| EP | 2488218 | B1 | | 3/2021 | |
| EP | 3522740 | B1 | | 3/2021 | |
| EP | 3104723 | B1 | | 8/2021 | |
| JP | 2009022752 | A | | 2/2009 | |
| KR | 101319228 | B1 | | 10/2013 | |
| KR | 200473510 | Y1 | | 8/2014 | |
| KR | 101682319 | B1 | | 12/2016 | |
| KR | 102027782 | B1 | | 10/2019 | |
| KR | 102027791 | B1 | | 10/2019 | |
| WO | WO-03082031 | A1 | | 10/2003 | |
| WO | WO-2007146893 | A2 | | 12/2007 | |
| WO | WO-2008015918 | A1 | | 2/2008 | |
| WO | WO-2013089358 | A1 | | 6/2013 | |
| WO | WO-2014020953 | A1 | | 2/2014 | |
| WO | WO-2015106434 | A1 | | 7/2015 | |
| WO | WO-2015107552 | A1 | | 7/2015 | |
| WO | WO-2015161407 | A1 | | 10/2015 | |
| WO | WO-2015165105 | A1 | | 11/2015 | |
| WO | WO-2015180073 | A1 | | 12/2015 | |
| WO | WO-2016000214 | A1 | | 1/2016 | |
| WO | WO-2016029389 | A1 | | 3/2016 | |
| WO | WO-2016045058 | A1 | | 3/2016 | |
| WO | WO-2016079151 | A1 | | 5/2016 | |
| WO | WO-2016082074 | A1 | | 6/2016 | |
| WO | WO-2016082217 | A1 | | 6/2016 | |
| WO | WO-2016090602 | A1 | | 6/2016 | |
| WO | WO-2016095220 | A1 | | 6/2016 | |
| WO | WO-2016096780 | A1 | | 6/2016 | |
| WO | WO-2016119098 | A1 | | 8/2016 | |
| WO | WO-2016119225 | A1 | | 8/2016 | |
| WO | WO-2016119496 | A1 | | 8/2016 | |
| WO | WO-2016127360 | A1 | | 8/2016 | |
| WO | WO-2016141508 | A1 | | 9/2016 | |
| WO | WO-2016145072 | A1 | | 9/2016 | |
| WO | WO-2016145613 | A1 | | 9/2016 | |
| WO | WO-2016172847 | A1 | | 11/2016 | |
| WO | WO-2016172898 | A1 | | 11/2016 | |
| WO | WO-2016172909 | A1 | | 11/2016 | |
| WO | WO-2016172954 | A1 | | 11/2016 | |
| WO | WO-2016179776 | A1 | | 11/2016 | |
| WO | WO-2016187695 | A1 | | 12/2016 | |
| WO | WO-2016197485 | A1 | | 12/2016 | |
| WO | WO-2016201602 | A1 | | 12/2016 | |
| WO | WO-2016202301 | A1 | | 12/2016 | |
| WO | WO-2016202302 | A1 | | 12/2016 | |
| WO | WO-2017015794 | A1 | | 2/2017 | |
| WO | WO-2017015832 | A1 | | 2/2017 | |
| WO | WO-2017020220 | A1 | | 2/2017 | |
| WO | WO-2017020221 | A1 | | 2/2017 | |
| WO | WO-2017024926 | A1 | | 2/2017 | |
| WO | WO-2017036819 | A1 | | 3/2017 | |
| WO | WO-2017036829 | A1 | | 3/2017 | |
| WO | WO-2017036879 | A1 | | 3/2017 | |
| WO | WO-2017042081 | A1 | | 3/2017 | |
| WO | WO-2017045897 | A1 | | 3/2017 | |
| WO | WO-2017045898 | A1 | | 3/2017 | |
| WO | WO-2017054424 | A1 | | 4/2017 | |
| WO | WO-2017063256 | A1 | | 4/2017 | |
| WO | WO-2017063535 | A1 | | 4/2017 | |
| WO | WO-2017066955 | A1 | | 4/2017 | |
| WO | WO-2017084488 | A1 | | 5/2017 | |
| WO | WO-2017084848 | A1 | | 5/2017 | |
| WO | WO-2017084849 | A1 | | 5/2017 | |
| WO | WO-2017093535 | A1 | | 6/2017 | |
| WO | WO-2017113106 | A1 | | 7/2017 | |
| WO | WO-2017122196 | A1 | | 7/2017 | |
| WO | WO-2017137510 | A1 | | 8/2017 | |
| WO | WO-2017139963 | A1 | | 8/2017 | |
| WO | WO-2017149288 | A1 | | 9/2017 | |
| WO | WO-2017167169 | A1 | | 10/2017 | |
| WO | WO-2017176113 | A1 | | 10/2017 | |
| WO | WO-2018048813 | A1 | | 3/2018 | |
| WO | WO-2019048880 | A1 | | 4/2019 | |
| WO | WO-2020023547 | A1 | | 1/2020 | |
| WO | WO-2020132079 | A1 | | 6/2020 | |

OTHER PUBLICATIONS

CN109222243A English translation obtained from Espacenet, pp. 1-5 (Year: 2019).*

CN 109222235 A English Translation obtained from Espacenet, pp. 1-4 (Year: 2019).*

* cited by examiner

CARTRIDGES FOR VAPORIZER DEVICES

CROSS-REFERENCE TO RELATED APPLICATIONS

This application is a continuation application, filed under 35 U.S.C. 120, of PCT International Patent Application No. PCT/US20/25336 with an International Filing Date of Mar. 27, 2020, and entitled "Cartridges for Vaporizer Devices," which claims priority to U.S. Provisional Application No. 62/826,049 filed on Mar. 29, 2019, and entitled "Cartridges for Vaporizer Devices," the disclosures of all of which are incorporated herein by reference in their entireties.

TECHNICAL FIELD

The subject matter described herein relates to vaporizer devices, including a disposable vaporizer cartridge.

BACKGROUND

Vaporizer devices, which can also be referred to as vaporizers, electronic vaporizer devices, or e-vaporizer devices, can be used for delivery of an aerosol (for example, a vapor-phase and/or condensed-phase material suspended in a stationary or moving mass of air or some other gas carrier) containing one or more active ingredients by inhalation of the aerosol by a user of the vaporizing device. For example, electronic nicotine delivery systems (ENDS) include a class of vaporizer devices that are battery powered and that can be used to simulate the experience of smoking, but without burning of tobacco or other substances. Vaporizer devices are gaining increasing popularity both for prescriptive medical use, in delivering medicaments, and for consumption of tobacco, nicotine, and other plant-based materials. Vaporizer devices can be portable, self-contained, and/or convenient for use.

In use of a vaporizer device, the user inhales an aerosol, colloquially referred to as "vapor," which can be generated by a heating element that vaporizes (e.g., causes a liquid or solid to at least partially transition to the gas phase) a vaporizable material, which can be liquid, a solution, a solid, a paste, a wax, and/or any other form compatible for use with a specific vaporizer device. The vaporizable material used with a vaporizer device can be provided within a vaporizer cartridge for example, a separable part of the vaporizer device that contains vaporizable material) that includes an outlet (for example, a mouthpiece) for inhalation of the aerosol by a user.

To receive the inhalable aerosol generated by a vaporizer device, a user may, in certain examples, activate the vaporizer device by taking a puff, by pressing a button, and/or by some other approach. A puff as used herein can refer to inhalation by the user in a manner that causes a volume of air to be drawn into the vaporizer device such that the inhalable aerosol is generated by a combination of the vaporized vaporizable material with the volume of air.

Vaporizer devices can be controlled by one or more controllers, electronic circuits (for example, sensors, heating elements), and/or the like on the vaporizer device. Vaporizer devices can also wirelessly communicate with an external controller for example, a computing device such as a smartphone).

A vaporizer device typically includes an atomizer that is configured to receive and heat vaporizable material and produce an inhalable aerosol instead of smoke. The atomizer can include a wicking element (e.g., a wick) that conveys an amount of a vaporizable material to a part of the atomizer that includes a heating element (e.g., conductive, convective, and/or radiative). Generally, in such instances, the heating element is in thermal communication with the wicking element, which is at least partially disposed within a reservoir chamber containing an amount of vaporizable material. As a result, when the wicking element is heated so as to vaporize at least a portion of the vaporizable material contained therein, an amount of heat is lost to the remaining amount of vaporizable material within the reservoir chamber. Therefore, to ensure a sufficient amount of vaporizable material within the wicking element is vaporized, excess energy is supplied by the heating element. Further, due to the lack of thermal insulation of the atomizer, additional thermal losses can be incurred, thereby requiring additional energy to be supplied. This lack of thermal insulation can also result in at least a portion of the supplied energy to dissipate to other areas of the vaporizer devices, which can lead to loss in structural integrity of the device, damage to internal components, etc. Moreover, due to the microstructure of the wicking element, it can also be difficult to control the amount and rate at which the vaporizable material is being drawn therein.

Accordingly, vaporizer devices and/or vaporizer cartridges that address one or more of these issues are desired.

SUMMARY

In certain aspects of the current subject matter, challenges associated with thermal losses can be addressed by inclusion of one or more of the features described herein or comparable/equivalent approaches as would be understood by one of ordinary skill in the art. Aspects of the current subject matter relate to vaporizer cartridges for use in a vaporizer device and vaporizer devices.

In some variations, one or more of the following features may optionally be included in any feasible combination.

In one exemplary embodiment, a cartridge is provided and includes a reservoir housing including a reservoir chamber configured to selectively hold a vaporizable material, and an atomizer in fluid communication with the reservoir chamber. The atomizer includes a substrate having an array of ordered pores configured to draw a predetermined volume of vaporizable material from the reservoir chamber at a predetermined rate, and at least one heating material configured to selectively heat the at least a portion of the vaporizable material drawn into the substrate to generate a vaporized material.

In some embodiments, the substrate can be in the form of a honeycomb structure. In other embodiments, the substrate can include an anodic aluminum oxide (AAO) membrane.

In some embodiments, the at least one heating material can be formed from a metal alloy. In one embodiment, the ordered pores can be plated with the at least one heating material. In another embodiment, the substrate can extend from a first surface to a second surface that is opposite the first surface, and at least the first surface can be positioned within the reservoir chamber and a layer of the at least one heating material can be disposed on the second surface.

The atomizer can have a variety of configurations. For example, in some embodiments, the atomizer can include at least one thermally insulating material disposed on at least a portion of the substrate. In one embodiment, the at least one thermally insulating material can include silicon dioxide. In another embodiment, the at least one thermally insulating material can be in the form of a tubular member having a lumen defined therein and the substrate can reside within the lumen.

In some embodiments, each pore can have a diameter from about 1 nm to 1000 nm. In other embodiments, each pore can have a length that extends from a first end to a second end, and the length can be between about 0 microns and 10 microns.

In another exemplary embodiment, a vaporizer is provided and includes a vaporizer body and a cartridge that is selectively coupled to and removable from the vaporizer body. The cartridge includes a reservoir housing including a reservoir chamber configured to selectively hold a vaporizable material, and an atomizer in fluid communication with the reservoir chamber. The atomizer includes a substrate having an array of ordered pores configured to draw a predetermined volume of vaporizable material from the reservoir chamber at a predetermined rate, and at least one heating material configured to selectively heat the at least a portion of the vaporizable material drawn into the substrate to generate a vaporized material.

In some embodiments, the substrate can be in the form of a honeycomb structure. In other embodiments, the substrate can include an anodic aluminum oxide (AAO) membrane.

In some embodiments, the at least one heating material can be formed from a metal alloy. In one embodiment, the ordered pores can be plated with the at least one heating material. In another embodiment, the substrate can extend from a first surface to a second surface that is opposite the first surface, and at least the first surface can be positioned within the reservoir chamber and a layer of the at least one heating material can be disposed on the second surface.

The atomizer can have a variety of configurations. For example, in some embodiments, the atomizer can also include at least one thermally insulating material disposed on at least a portion of the substrate. In one embodiment, the at least one thermally insulating material can include silicon dioxide. In another embodiment, the at least one thermally insulating material can be in the form of a tubular member having a lumen defined therein and the substrate can reside within the lumen.

In some embodiments, each pore can have a diameter from about 1 nm to 1000 nm. In other embodiments, each pore can have a length that extends from a first end to a second end, and the length can be between about 0 microns and 10 microns.

In some embodiments, the vaporizer body can include a power source.

The details of one or more variations of the subject matter described herein are set forth in the accompanying drawings and the description below. Other features and advantages of the subject matter described herein will be apparent from the description and drawings, and from the claims. The claims that follow this disclosure are intended to define the scope of the protected subject matter.

BRIEF DESCRIPTION OF THE DRAWINGS

The accompanying drawings, which are incorporated into and constitute a part of this specification, show certain aspects of the subject matter disclosed herein and, together with the description, help explain some of the principles associated with the disclosed implementations. In the drawings.

When practical, similar reference numbers denote similar structures, features, or elements.

DETAILED DESCRIPTION

Figure 1:
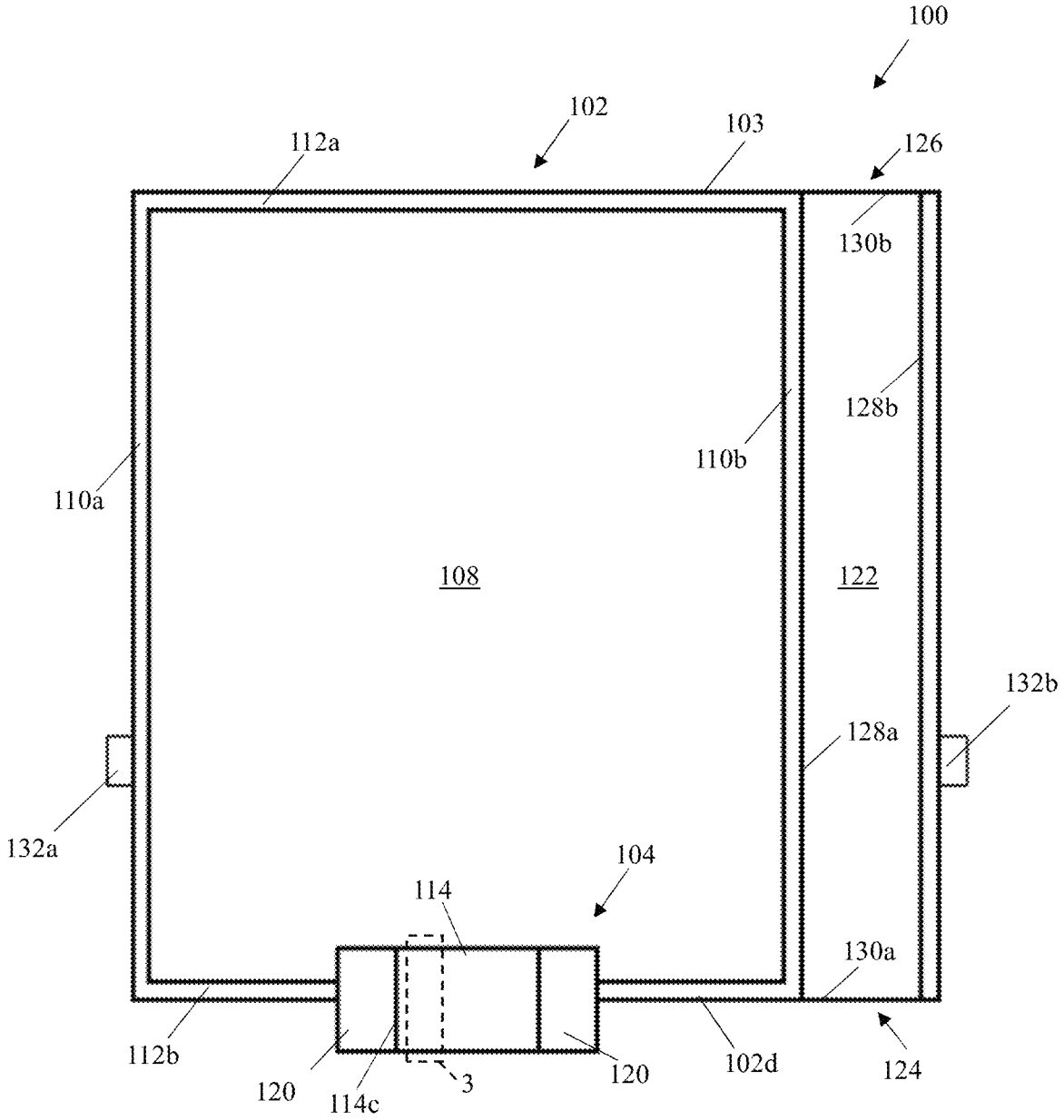
FIG. 1 illustrates a schematic cross-sectional view of an embodiment of a vaporizer cartridge having a reservoir chamber and an atomizer that includes a substrate.

Implementations of the current subject matter include methods, apparatuses, articles of manufacture, and systems relating to vaporization of one or more materials for inhalation by a user. Example implementations include vaporizer devices and systems including vaporizer devices. The term "vaporizer device" as used in the following description and claims refers to any of a self-contained apparatus, an apparatus that includes two or more separable parts (for example, a vaporizer body that includes a battery and other hardware, and a vaporizer cartridge that includes a vaporizable material), and/or the like. A "vaporizer system," as used herein, can include one or more components, such as a vaporizer device. Examples of vaporizer devices consistent with implementations of the current subject matter include electronic vaporizers, electronic nicotine delivery systems (ENDS), and/or the like. In general, such vaporizer devices are hand-held devices that heat (such as by convection, conduction, radiation, and/or some combination thereof) a vaporizable material to provide an inhalable dose of the material.

The vaporizable material used with a vaporizer device can be provided within a vaporizer cartridge (for example, a part of the vaporizer device that contains the vaporizable material in a reservoir or other container) which can be refillable when empty, or disposable such that a new vaporizer cartridge containing additional vaporizable material of a same or different type can be used.

In some embodiments, a vaporizer device can be configured for use with a liquid vaporizable material (for example, a carrier solution in which an active and/or inactive ingredient(s) are suspended or held in solution, or a liquid form of the vaporizable material itself), a paste, and/or a wax. The liquid vaporizable material can be capable of being completely vaporized, or can include some portion of the liquid material that remains after all of the material suitable for inhalation has been vaporized.

As mentioned above, existing vaporizer devices can include a wicking element that is at least partially disposed within a reservoir chamber containing an amount of vaporizable material, and a heating element in thermal communication with the wicking element to thereby heat the vaporizable material drawn into the wicking element. As a result, thermal losses can be incurred (e.g., the remaining amount of vaporizable material within the reservoir chamber can act as a heat sink). Further, the lack of thermal insulation between the wicking and heating elements, can lead to additional thermal losses. Therefore, to ensure a sufficient amount of vaporizable material within the wicking element is vaporized, more energy is supplied by the heating element. Additionally, due to the microstructure of existing wicking elements, it can be difficult to control the amount and rate at which the vaporizable material is being drawn therein. This can also lead to thermal losses, for example, in instances where an insufficient amount of vaporizable material is drawn into the wicking element. Various features and devices are described below that improve upon or overcome these foregoing issues.

The vaporizer cartridges described herein utilize an atomizer that includes a substrate having an array of ordered pores that allow for a more controlled delivery of vaporizable material to the heating area of the vaporizer device. As an example, the structural dimensions of the ordered pores (e.g., diameter, length, density, or the like) can be tailored to control the amount of and/or the rate at which vaporizable material is drawn into the atomizer (e.g., from a reservoir chamber that contains an amount of vaporizable material) for subsequent vaporization. As such, the array of ordered pores can be configured to draw a predetermined volume of vaporizable material, e.g., from a reservoir chamber. Moreover, the array of ordered pores can be configured to draw the vaporizable material, e.g., the predetermined volume of the vaporizable material, at a predetermined rate. In a further aspect, the array of ordered pores provides a smaller, defined heating area for vaporizable material. As used herein, "ordered pores" are pores that are generally uniform in size and shape and generally oriented in a single direction. Further, as used herein, "generally uniform" when referring to size and shape refers to a size and a shape each within a predetermined dimensional tolerance, and "generally oriented" refers to an orientation within a predetermined angular tolerance.

As discussed in greater detail below, the atomizer allows for vaporizable material to be withdrawn and separated from the remaining amount of vaporizable material within the reservoir chamber, avoiding unnecessary heating of the remaining vaporizable material when vaporizing the vaporizable material within the atomizer. As a result, thermal efficiency can be optimized. While the present substrates are described herein as having an array of ordered pores, it is also contemplated herein, that the substrates can alternatively include an array of unordered pores.

Vaporizer cartridges consistent with implementations of the current subject matter generally include a reservoir housing having a reservoir chamber being configured to selectively hold a vaporizable material, and an atomizer that is in fluid communication with the reservoir chamber. As discussed in more detail below, the atomizer includes a substrate having an array of ordered pores that are configured to draw at least a portion of the vaporizable material from the reservoir chamber. It is also contemplated herein that in other embodiments, the atomizer can include an array of unordered pores that are configured to draw at least a portion of the vaporizable material from the reservoir chamber.

The reservoir housing can have a variety of configurations. In general, the reservoir housing includes at least one wall that defines the reservoir chamber. In some embodiments, the reservoir housing can have a substantially rectangular configuration. In other embodiments, the reservoir can have any other possible shape.

The substrate can have a variety of configurations. In general, the substrate extends from a first surface to a second surface that is opposite the first surface. In some embodiments, the first surface can be positioned within the reservoir chamber, and therefore in direct contact with vaporizable material disposed therein. In this way, a portion of the substrate resides within the reservoir chamber. The substrate can have any suitable shape and size. In one embodiment, the substrate can have a substantially cylindrical shape, whereas in other embodiments, the substrate can have a substantially rectangular shape. The size and shape of the substrate can be dependent at least upon the structural dimensions of the other components of the vaporizer cartridge and the vaporizer cartridge itself. For example, in various embodiments, the first and second surfaces may optionally be parallel or at least approximately parallel. In other embodiments, the first and second surfaces may have other relative orientations. In certain embodiments, one or both of the first and second surfaces may optionally be at least approximately planar. In other embodiments, either or both of the first and second surface may be curved, undulating, ridged, or otherwise be non-planar on at least some of the surface.

In some embodiments, the substrate can be in the form of a honeycomb structure. In other embodiments, the substrate can have any other possible suitable structure. Further, the substrate can have a variety of shapes and sizes. For example, the substrate can have an average pore size from about 1 nanometer to about 1000 nanometers. The substrate can have a thickness or depth up to about 10 microns. A person skilled in the art will appreciate that the average pore size and thickness can be dependent at least upon the structural parameters of the vaporizer cartridge and vaporizer device and the rheological characteristics of the vaporizable material. As a result, in other embodiments, the substrate can have any suitable average pore size and/or thickness that allows the vaporizable material to be drawn into the substrate for vaporization.

The substrate can be formed of any suitable material. For example, in some embodiments, the substrate can be formed of one or more electrically conductive materials, e.g., one or more metals or the like, whereas in other embodiments, the substrate can be formed of one or more electrically insulating materials, e.g., one or more polymers, ceramics, or the like. In one embodiment, the substrate can be formed of both conductive and non-conductive materials.

In some embodiments, the substrate can be formed from one or more metals. As such, in such embodiments, the substrate can be configured to function as both the wicking and heating elements of the atomizer. That is, the array of ordered pores can be configured to draw vaporizable material from the reservoir chamber into the substrate, and the substrate can be configured to selectively heat at least a portion of the vaporizable material received therein into a vaporized material (e.g., in response to being activated by a power source of the vaporizer device). In this way, the vaporizable material within the substrate can be vaporized in response to bulk heating of the substrate.

In some embodiments, the substrate can include an anodic aluminum oxide (AAO) membrane. The AAO membrane can be formed using any suitable electrochemical process. The interior diameter of the pores in the membrane, the distance between the centers of adjacent pores in the membrane, and the distance between the edges of adjacent pores in the membrane can be controlled by the voltage of the deposition, the type of acid, and other parameters.

The substrate includes an array of ordered pores. The array of ordered pores can be configured to control a flow rate of the vaporizable material being withdrawn from the reservoir chamber along the ordered pores. The ordered pores can have any suitable shape and size that allows at least a portion of the vaporizable material to be drawn into the substrate. In use, vaporizable material is drawn into the pores, and thus substrate, at least in part by capillary action. As a result, the amount of vaporizable material and the rate at which the vaporizable material is drawn into the substrate during use of the vaporizer device can be controlled by at least the size of the pores. Each pore can extend from a first end to a second end. While each pore can extend in a variety of directions, in some embodiments, the pores can extend along the depth of the substrate such that the first end of the pores is at the first surface of the substrate and the second end of the pores is at the second surface of the substrate. In this way, depending at least upon the structural configuration of the substrate, at least the first end of the pores is in direct contact with the vaporizable material within the reservoir chamber. As such, the vaporizable material can be drawn into the substrate through the first end of the pore towards the second end of the pore, and thus the second surface of the substrate via capillary action.

The size of the pores can be tailored such that the surface tension between the vaporizable material and the pores themselves is effective to prevent vaporizable material from flowing out of the substrate while the pressure of the reservoir chamber is approximately the same as the pressure outside of the reservoir chamber (e.g., along an airflow passageway of the vaporizer device). That is, under circumstances where there is approximately no pressure differential between the first and second ends of the pores (e.g., corresponding to a state where a user is not actively puffing on the vaporizer device), the flow of vaporizable material out of the pores is inhibited. Further, the size of the pores can be tailored such that the surface tension is overcome, allowing vaporizable material to flow out of the substrate, when the pressure within the reservoir chamber is less than the pressure along an airflow passageway of the vaporizer device. That is, under circumstances where there is a pressure differential between the first and second ends of the pores (e.g., corresponding to a state where a user actively puffs on the vaporizer device), the vaporizable material can flow out of the pores.

In some embodiments, each pore can have a diameter from about 1 nm to 1000 nm. In some embodiments, each pore can have a length that extends from its first end to its second end. The length of each pore can be between about 0 microns and 10 microns. In certain embodiments, the length of each pore can be substantially equal to the depth of the substrate. A person skilled in the art will appreciate that the pores can have other suitable diameters and lengths.

In embodiments where the substrate itself is not configured to heat the vaporizable material contained therein into vaporized material (e.g., when the substrate is formed from an electrically insulating material), the substrate can include at least one heating material. The at least one heating material can be configured to selectively heat the portion of the vaporizable material within the substrate into a vaporized material. The at least one heating material can include any suitable electrically conductive material that can generate an effective amount of heat (e.g., in response to be being activated by a power source of the vaporizer device) to vaporize the vaporizable material within the substrate. As such, the at least one heating material can be configured to function as the heating element of the atomizer. Non-limiting examples of suitable heating materials include metal alloys, e.g., stainless steel or the like.

The at least one heating material can be incorporated into the substrate in a variety of ways. For example, in some embodiments, the array of ordered pores can be plated with the at least one heating material. The first and/or second surfaces of the substrate can also be plated with the at least one heating material. In instances where the first surface of the substrate is plated with the at least one heating material, the length of each pore can extend along the depth or thickness of the substrate, plus the thickness or depth of the plated heating material on the first surface. In instances where the first and second surfaces of the substrate are plated with the at least one heating material, the length of each pore can extend along the depth or thickness of the substrate, plus the thickness or depth of the plated heating material on the first and second surfaces. The at least one heating material can be plated onto the surfaces of the ordered pores and/or the first and/or second surfaces of the substrate using any suitable method, e.g., physical or chemical vapor deposition. In other embodiments, the at least one heating material can be in the form of one or more inserts that are inserted into the substrate. In yet other embodiments, the at least one heating material can be deposited onto at least a portion of the second surface of the substrate, thereby resulting in a multi-layer structure.

In some embodiments, the atomizer can also include at least one thermally insulating material that is disposed on at least a portion of the substrate. The at least one thermally insulating material can be used to inhibit transfer of heat from either the substrate itself or the at least one heating material incorporated within the substrate to the remaining vaporizable material within the reservoir chamber and/or to other areas of the vaporizer device. As a result, thermal losses can be reduced and a lower amount of energy can be used to effect vaporization of the vaporizable material within the substrate, as compared to the amount of energy that is needed for existing atomizers.

The at least one thermally insulating material can include any suitable material that can substantially inhibit heat transfer from the substrate itself or the at least one heating material. Non-limiting examples of suitable thermally insulating materials include silicon dioxide or the like.

Further, the at least one thermally insulating material can be incorporated within the atomizer in a variety of configurations. For example, in one embodiment, the at least one insulating material can be formed as a tubular member having a lumen defined therein. As such, the substrate can reside within the lumen, and therefore is insulated. In another embodiment, the at least one insulting material can be disposed on a portion of the substrate, e.g., as a layer on a planar surface of the substrate.

In some embodiments, the vaporizer cartridge can be selectively coupled to and removable from a vaporizer body of a vaporizer device using a coupling mechanism. For example, the vaporizer cartridge and the vaporizer body can each include corresponding coupling elements that are configured to releasably engage with each other. That is, in use, once a predetermined length of the vaporizer cartridge is inserted into the vaporizer body, the corresponding coupling elements can engage with each other, thereby securing the vaporizer cartridge to the vaporizer body. Likewise, once the vaporizer cartridge needs to be replaced (or refilled), the corresponding coupling elements can be disengaged such that the vaporizer cartridge can be removed. And subsequently, a new vaporizer cartridge or the refilled vaporizer cartridge can be selectively coupled or recoupled, respectively, to the vaporizer body. Further, the position of the corresponding coupling elements can be dependent at least upon the desired length of the vaporizer cartridge to be inserted into the vaporizer body, for example, to avoid the substrate and/or the at least one heating material from damage caused by an insertion force.

In some embodiments, the vaporizer body of a vaporizer device can include a cartridge receptacle that is configured to receive at least a portion of the vaporizer cartridge. In one embodiment, the cartridge receptacle can be defined by a sleeve of the vaporizer body.

In one example of coupling elements for coupling the vaporizer cartridge to the vaporizer body, the vaporizer body can include one or more detents (for example, dimples, protrusions, etc.) protruding inwardly from an inner surface of the cartridge receptacle, additional material (such as metal, plastic, etc.) formed to include a portion protruding into the cartridge receptacle, and/or the like. One or more exterior surfaces of the vaporizer cartridge can include corresponding recesses that can fit and/or otherwise snap over such detents or protruding portions when the vaporizer cartridge is inserted into the cartridge receptacle of the vaporizer body. When the vaporizer cartridge and the vaporizer body are coupled (e.g., by insertion of the vaporizer cartridge into the cartridge receptacle of the vaporizer body), the detents or protrusions of the vaporizer body can fit within and/or otherwise be held within the recesses of the vaporizer cartridge, to hold the vaporizer cartridge in place when assembled. Such an assembly can provide enough support to hold the vaporizer cartridge in place during use, while allowing release of the vaporizer cartridge from the vaporizer body when a user pulls with reasonable force on the vaporizer cartridge to disengage the vaporizer cartridge from the cartridge receptacle. In other embodiments, the exterior surfaces of the vaporizer cartridge can include one or more detents and the cartridge receptacle can include one or more recesses.

In some embodiments, the vaporizer cartridge, or at least an insertable end of the vaporizer cartridge configured for insertion in the cartridge receptacle, can have a non-circular cross section transverse to the axis along which the vaporizer cartridge is inserted into the cartridge receptacle. For example, the non-circular cross section can be approximately rectangular, approximately elliptical (i.e., have an approximately oval shape), non-rectangular but with two sets of parallel or approximately parallel opposing sides (i.e., having a parallelogram-like shape), or other shapes having rotational symmetry of at least order two. In this context, approximate shape indicates that a basic likeness to the described shape is apparent, but that sides of the shape in question need not be completely linear and vertices need not be completely sharp. Rounding of both or either of the edges or the vertices of the cross-sectional shape is contemplated in the description of any non-circular cross section referred to herein.

The vaporizer device can also include a power source (for example, a battery, which can be a rechargeable battery), and a controller (for example, a processor, circuitry, etc. capable of executing logic) for controlling delivery of heat from the substrate and/or the at least one heating material to cause a vaporizable material to be converted from a condensed form (for example, a wax, a paste, a liquid, a solution, a suspension, etc.) to the gas phase. The controller can be part of one or more printed circuit boards (PCBs) consistent with certain implementations of the current subject matter.

After conversion of the vaporizable material to the gas phase, at least some of the vaporizable material in the gas phase can condense to form particulate matter in at least a partial local equilibrium with a portion of the vaporizable material that remains in the gas phase. The vaporizable material in the gas phase as well as the condensed phase are part of an aerosol, which can form some or all of an inhalable dose provided by the vaporizer device during a user's puff or draw on the vaporizer device. It should be appreciated that the interplay between the gas phase and condensed phase in an aerosol generated by a vaporizer device can be complex and dynamic, due to factors such as ambient temperature, relative humidity, chemistry, flow conditions in airflow paths (both inside the vaporizer device and in the airways of a human or other animal), and/or mixing of the vaporizable material in the gas phase or in the aerosol phase with other air streams, which can affect one or more physical parameters of an aerosol. In some vaporizer devices, and particularly for vaporizer devices configured for delivery of volatile vaporizable materials, the inhalable dose can exist predominantly in the gas phase (for example, formation of condensed phase particles can be very limited).

As discussed above, the array of ordered pores can be configured to draw at least a portion of the vaporizable material contained within the reservoir chamber into the substrate. The substrate itself and/or the at least one heating material can be configured to vaporize at least a portion of the vaporizable material when activated. As such, electrical contacts can be attached to the substrate so as to operatively couple the substrate and/or the at least one heating material to at least a power source, e.g., a power source disposed within a vaporizer body. The electrical contacts can have a variety of configurations. For example, in one embodiment, the electrical contacts are in the form of wires, which can be over molded.

The substrate and/or the at least one heating material can be activated to generate heat by a variety of mechanisms. For example, the substrate and/or the at least one heating material can be activated in association with a user puffing (i.e., drawing, inhaling, etc.) directly on the vaporizer cartridge itself, or alternatively, on a mouthpiece coupled thereto, to cause air to flow from an air inlet, along an airflow path that passes the atomizer. Optionally, air can flow from an air inlet through one or more condensation areas or chambers, to an outlet in the vaporizer cartridge itself, or alternatively, in a mouthpiece that is coupled thereto. Incoming air moving along the airflow path moves over or through the atomizer, where vaporizable material in the gas phase is entrained into the air. The at least one heating material can be activated via the controller, which can optionally be a part of a vaporizer body as discussed herein, causing current to pass from the power source through a circuit including the substrate and/or the at least one heating material. The entrained vaporizable material in the gas phase can condense as it passes through the remainder of the airflow path, which also travels through the interior of the vaporizer cartridge (for example, through one or more internal channels therein) such that an inhalable dose of the vaporizable material in an aerosol form can be delivered from an outlet (for example, in the vaporizer cartridge itself and/or in a mouthpiece coupled thereto) for inhalation by a user. In some embodiments, the vaporizer cartridge includes an internal channel extending through the vaporizer cartridge from an inlet to an outlet of the vaporizer cartridge. In one embodiment, a sidewall of the reservoir housing can at least partially define a sidewall of the internal channel.

Activation of the substrate and/or the at least one heating material can be caused by automatic detection of a puff based on one or more signals generated by one or more sensors. The one or more sensors and the signals generated by the one or more sensors can include one or more of: a pressure sensor or sensors of the vaporizer device to detect pressure along the airflow path relative to ambient pressure (or optionally to measure changes in absolute pressure), a motion sensor or sensors (for example, an accelerometer) of the vaporizer device, a flow sensor or sensors of the vaporizer device, a capacitive lip sensor of the vaporizer device, detection of interaction of a user with the vaporizer device via one or more input devices (for example, buttons or other tactile control devices of the vaporizer device), receipt of signals from a computing device in communication with the vaporizer device, and/or via other approaches for determining that a puff is occurring or imminent.

As discussed herein, the vaporizer device consistent with implementations of the current subject matter can be configured to connect (such as, for example, wirelessly or via a wired connection) to a computing device (or optionally two or more devices) in communication with the vaporizer device. To this end, the controller can include communication hardware. The controller can also include a memory. The communication hardware can include firmware and/or can be controlled by software for executing one or more cryptographic protocols for the communication.

A computing device can be a component of a vaporizer system that also includes the vaporizer device, and can include its own hardware for communication, which can establish a wireless communication channel with the communication hardware of the vaporizer device. For example, a computing device used as part of a vaporizer system can include a general-purpose computing device (such as a smartphone, a tablet, a personal computer, some other portable device such as a smartwatch, or the like) that executes software to produce a user interface for enabling a user to interact with the vaporizer device. In other implementations of the current subject matter, such a device used as part of a vaporizer system can be a dedicated piece of hardware such as a remote control or other wireless or wired device having one or more physical or soft (i.e., configurable on a screen or other display device and selectable via user interaction with a touch-sensitive screen or some other input device like a mouse, pointer, trackball, cursor buttons, or the like) interface controls.

The vaporizer device can also include one or more outputs or devices for providing information to the user. For example, the outputs can include one or more light emitting diodes (LEDs) configured to provide feedback to a user based on a status and/or mode of operation of the vaporizer device. In some aspects, the one or more outputs can include a plurality of LEDs (i.e., two, three, four, five, or six LEDs). The one or more outputs (i.e., each individual LED) can be configured to display light in one or more colors (for example, white, red, blue, green, yellow, etc.). The one or more outputs can be configured to display different light patterns (for example, by illuminating specific LEDs, varying a light intensity of one or more of the LEDs over time, illuminating one or more LEDs with a different color, and/or the like) to indicate different statuses, modes of operation, and/or the like of the vaporizer device. In some implementations, the one or more outputs can be proximal to and/or at least partially disposed within a bottom end region of the vaporizer device. The vaporizer device may, additionally or alternatively, include externally accessible charging contacts, which can be proximate to and/or at least partially disposed within the bottom end region of the vaporizer device.

In the example in which a computing device provides signals related to activation of the heating element (e.g., the substrate and/or the at least one heating material), or in other examples of coupling of a computing device with the vaporizer device for implementation of various control or other functions, the computing device executes one or more computer instruction sets to provide a user interface and underlying data handling. In one example, detection by the computing device of user interaction with one or more user interface elements can cause the computing device to signal the vaporizer device to activate the heating element to reach an operating temperature for creation of an inhalable dose of vapor/aerosol. Other functions of the vaporizer device can be controlled by interaction of a user with a user interface on a computing device in communication with the vaporizer device.

The temperature of the substrate and/or the at least one heating material, when configured as a resistive heating element, can depend on a number of factors, including an amount of electrical power delivered to the resistive heating element and/or a duty cycle at which the electrical power is delivered, conductive heat transfer to other parts of the electronic vaporizer device and/or to the environment, latent heat losses due to vaporization of the vaporizable material from the substrate and/or the atomizer as a whole, and convective heat losses due to airflow (i.e., air moving across the heating element or the atomizer as a whole when a user inhales on the vaporizer device). As noted herein, to reliably activate the heating element or heat the heating element to a desired temperature, the vaporizer device may, in some implementations of the current subject matter, make use of signals from the sensor (for example, a pressure sensor) to determine when a user is inhaling. The sensor can be positioned in the airflow path and/or can be connected (for example, by a passageway or other path) to an airflow path containing an inlet for air to enter the vaporizer device and an outlet via which the user inhales the resulting vapor and/or aerosol such that the sensor experiences changes (for example, pressure changes) concurrently with air passing through the vaporizer device from the air inlet to the air outlet. In some implementations of the current subject matter, the heating element (e.g., the substrate and/or the at least one heating material) can be activated in association with a user's puff, for example by automatic detection of the puff, or by the sensor detecting a change (such as a pressure change) in the airflow path.

The sensor can be positioned on or coupled to (i.e., electrically or electronically connected, either physically or via a wireless connection) the controller (for example, a printed circuit board assembly or other type of circuit board). To take measurements accurately and maintain durability of the vaporizer device, it can be beneficial to provide a seal resilient enough to separate an airflow path from other parts of the vaporizer device. The seal, which can be a gasket, can be configured to at least partially surround the sensor such that connections of the sensor to the internal circuitry of the vaporizer device are separated from a part of the sensor exposed to the airflow path. In an example of a cartridge-based vaporizer, the seal can also separate parts of one or more electrical connections between the vaporizer body and the vaporizer cartridge. Such arrangements of the seal in the vaporizer device can be helpful in mitigating against potentially disruptive impacts on vaporizer components resulting from interactions with environmental factors such as water in the vapor or liquid phases, other fluids such as the vaporizable material, etc., and/or to reduce the escape of air from the designated airflow path in the vaporizer device. Unwanted air, liquid or other fluid passing and/or contacting circuitry of the vaporizer device can cause various unwanted effects, such as altered pressure readings, and/or can result in the buildup of unwanted material, such as moisture, excess vaporizable material, etc., in parts of the vaporizer device where they can result in poor pressure signal, degradation of the sensor or other components, and/or a shorter life of the vaporizer device. Leaks in the seal can also result in a user inhaling air that has passed over parts of the vaporizer device containing, or constructed of, materials that may not be desirable to be inhaled.

FIG. 1 illustrates an exemplary vaporizer cartridge 100 for a vaporizer device. More specifically, the vaporizer cartridge 100 includes a reservoir housing 102 and an atomizer 104 that is fluid communication with a reservoir chamber 108. For purposes of simplicity only, certain components of the vaporizer cartridge 100 are not illustrated.

The reservoir housing 102 includes the reservoir chamber 108. The reservoir chamber 108 is configured to hold a vaporizable material (not shown). While the reservoir housing 102 can have a variety of sizes and shapes, the reservoir housing 102, as shown in FIG. 1, is substantially rectangular in shape. The reservoir housing 102 includes at least two sets of opposing sidewalls in which the first set of opposing sidewalls 110*a*, 110*b* extends substantially perpendicular to the second set of opposing sidewalls 112*a*, 112*b*. As shown, these sidewalls 110*a*, 110*b*, 112*a*, 112*b* define at least a portion of the reservoir chamber 108. In other embodiments, the reservoir housing 102 can be sized and shaped differently, including any other possible shape.

Figure 2:
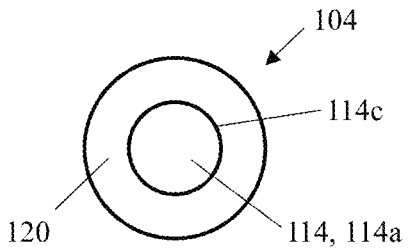
FIG. 2 is a top view of the atomizer of FIG. 1.
Figure 3:
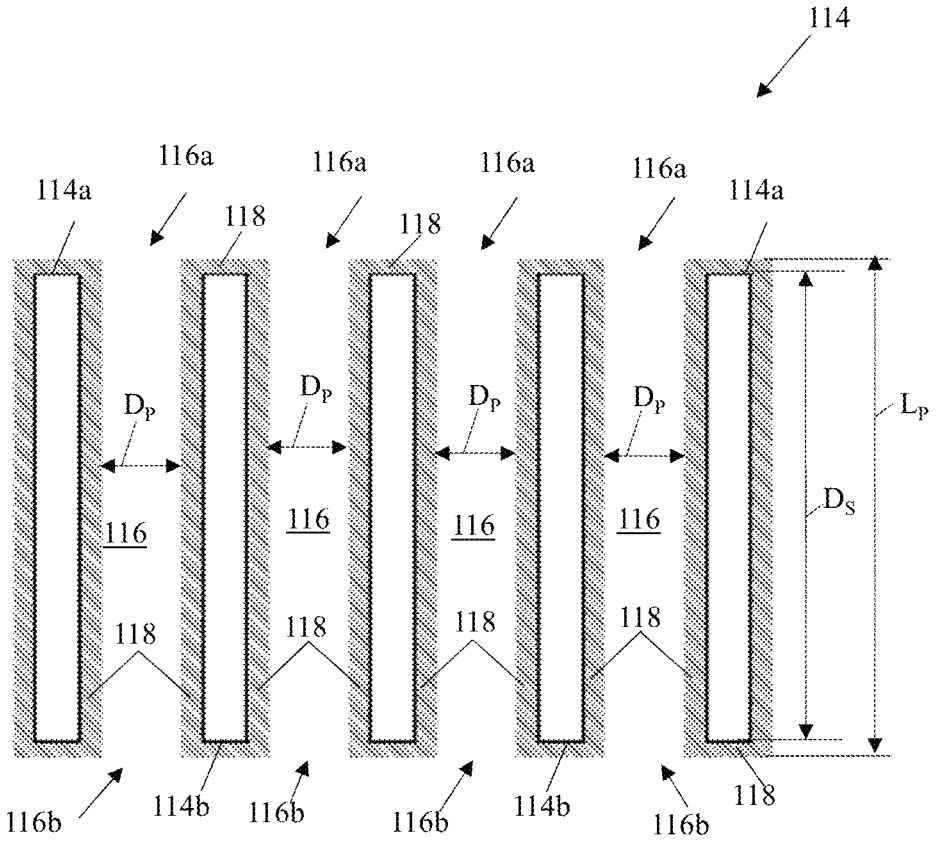
FIG. 3 is a magnified view of a portion of the substrate of FIG. 1 taken at 3.

While the atomizer 104 can have a variety of configurations, the atomizer 104, as shown in FIGS. 1-3, includes a substrate 114. In this illustrated embodiment, the substrate 114 is substantially cylindrical in shape, as further shown in FIG. 2, and therefore includes a first surface 114*a*, a second opposing surface 114*b*, and a third curved surface 114*c* extending between the first and second surfaces 114*a*, 114*b*. In this illustrated embodiment, the substrate 114 partially resides within the reservoir chamber 108. In particular, the first surface 114*a* is positioned within the reservoir chamber 108 and the second surface 114*b* is positioned distal to the reservoir housing 102. In other embodiments, the second surface 114*b* can be flush with the distal end 102*d* of the reservoir housing 102.

Figure 4:
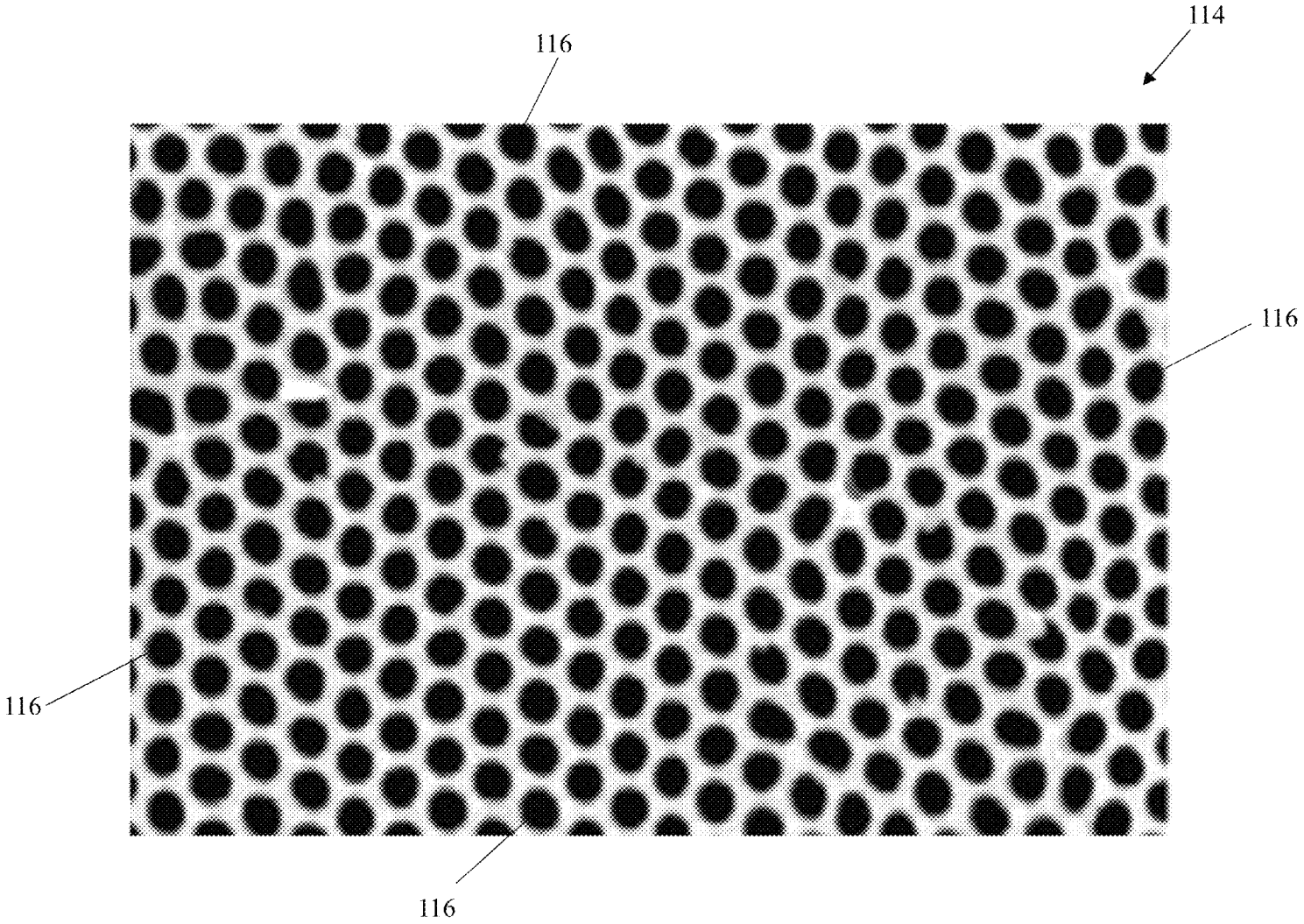
FIG. 4 is a top down scanning electron microscope (SEM) image of a portion of the substrate of FIG. 1.

As shown in more detail in FIGS. 3 and 4, the substrate 114 includes an array of ordered pores 116 with each pore extending from a first end 116*a* to a second end 116*b*. In this illustrated embodiment, the substrate 114 is an anodic aluminum oxide (AAO) membrane. In use, the array of ordered pores 116 draw at least a portion of the vaporizable material (not shown) from the reservoir chamber 108 and into the substrate 114 via capillary action for vaporization. As discussed above, the structural dimensions (e.g., diameter and length) of the pores 116 and/or density of the pores 116 within the substrate 114 can control the flow rate of the vaporizable material from the reservoir chamber 108. The pores 116 can extend at a length ($L_P$) along the depth of the substrate ($D_S$). As shown, the first end 116*a* of the pores 116 is at the first surface 114*a* of the substrate 114 and the second end 116*b* of the pores 116 is at the second surface 114*b* of the substrate 114. As a result, in use, when the reservoir chamber 108 is filled with vaporizable material, the vaporizable material is drawn into the substrate 114 through the first end 116*a* of the pores 116 and towards the second end 116*b* of the pores 116, and consequently, from the first surface 114*a* towards the second surface 114*b* of the substrate 114, for vaporization.

The atomizer 104 also includes at least one heating material 118 and a thermally insulating material 120. As shown in FIG. 3, the at least one heating material 118 is plated on the surface of the pores 116 and on the first and second surfaces 114*a*, 114*b* of the substrate 114. As such, the pores 116 extend a length ($L_P$) along the depth or thickness of the substrate 114, plus the depth or thickness of the at least one heating material 118 plated on the first surface 114*a* and on the second surface 114*b* of the substrate 114. In use, the at least one heating material 118 is activated to generate heat so as to vaporize the vaporizable material that is drawn within the substrate 114. As further shown, the thermally insulating material 120 is in the form of a tubular member with a lumen defined therein. The substrate 114 resides within the lumen such that the thermally insulating material 120 is disposed about the third curved surface 114*c* of the substrate 114. In this way, the thermally insulating material 120 can substantially contain the heat being generated by the at least one heating material 118 to that of the substrate 114, thereby hindering dissipation of the heat to the remaining vaporizable material in the reservoir chamber 108. As a result, this can reduce heat losses during vaporization of the vaporizable material within the substrate 114, thereby increasing the efficiency of the atomizer 104. As discussed above, this reduction in heat loss can effect vaporization using lower amounts of energy compared to the amount of energy needed for vaporization using known atomizers.

As shown in FIG. 1, the vaporizer cartridge 100 also includes an internal channel 122 that extends from an inlet 124 to an outlet 126 of the vaporizer cartridge 100. The internal channel 122 is configured to direct air and vaporized material through the vaporizer cartridge 100 for inhalation by a user. While the internal channel 122 can have a variety of configurations, the internal channel 122, as shown in FIG. 1, is defined by two sets of opposing sidewalls 128*a*, 128*b*, 130*a*, 130*b*. In other embodiments, the internal channel 122 can be sized and shaped differently, including any other possible shape. In use, a user can puff on an end 103 of the vaporizer cartridge 100 such that the air and vaporized material within the vaporizer cartridge 100 can be delivered directly to the user from the outlet 126 for inhalation. Alternatively, a mouthpiece (not shown) can be coupled to the end 103 of the vaporizer cartridge 100, in which case the user can puff on the mouthpiece rather than directly on the end 103 of the vaporizer cartridge 100. As such, the air and vaporized material within the vaporizer cartridge 100 can travel from the outlet 126 into the mouthpiece for inhalation by the user.

Figure 5:
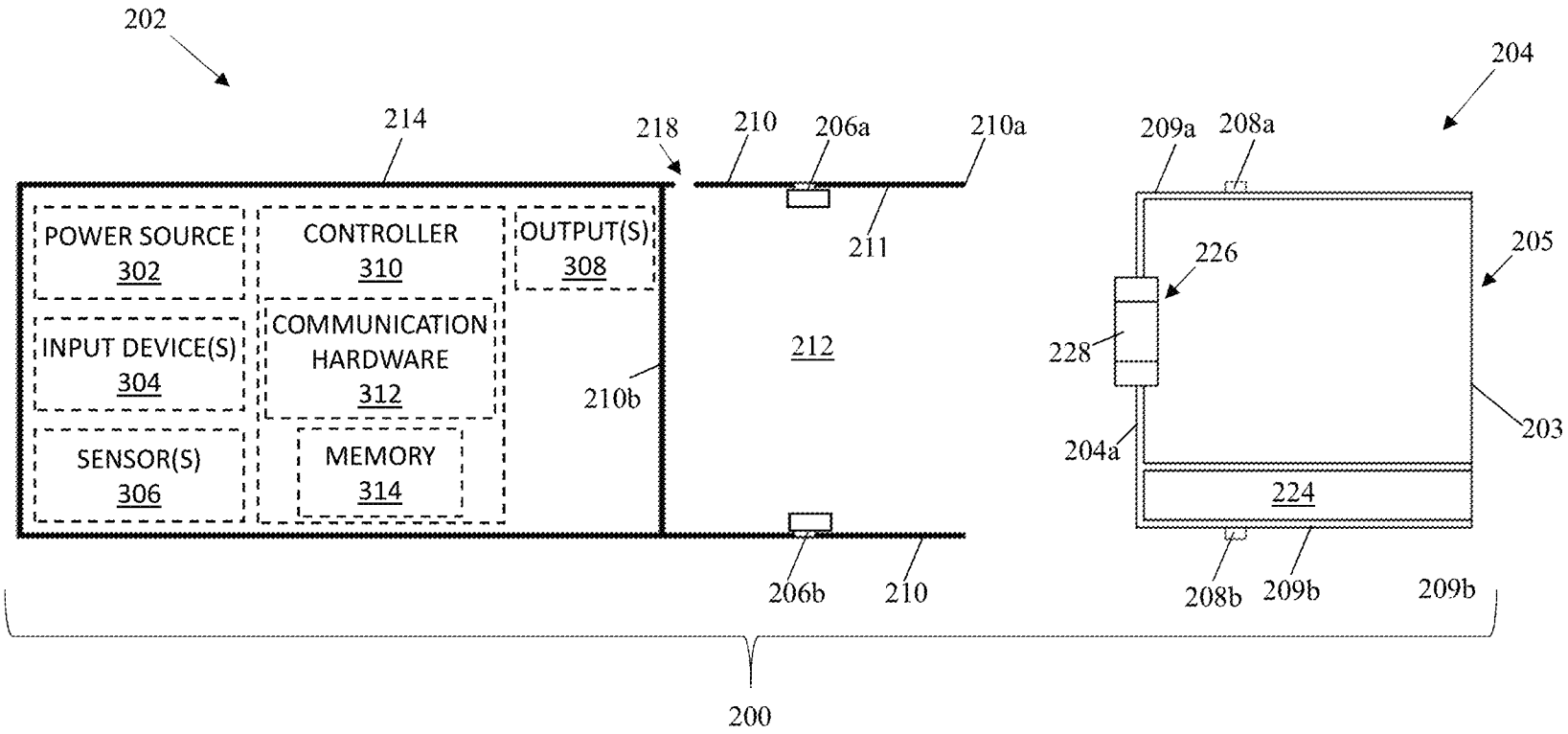
FIG. 5 is a partially transparent top view of an embodiment of a vaporizer device that includes a vaporizer body and a vaporizer cartridge having a reservoir chamber and an atomizer, showing the vaporizer cartridge and the vaporizer body separated from each other.
Figure 6:
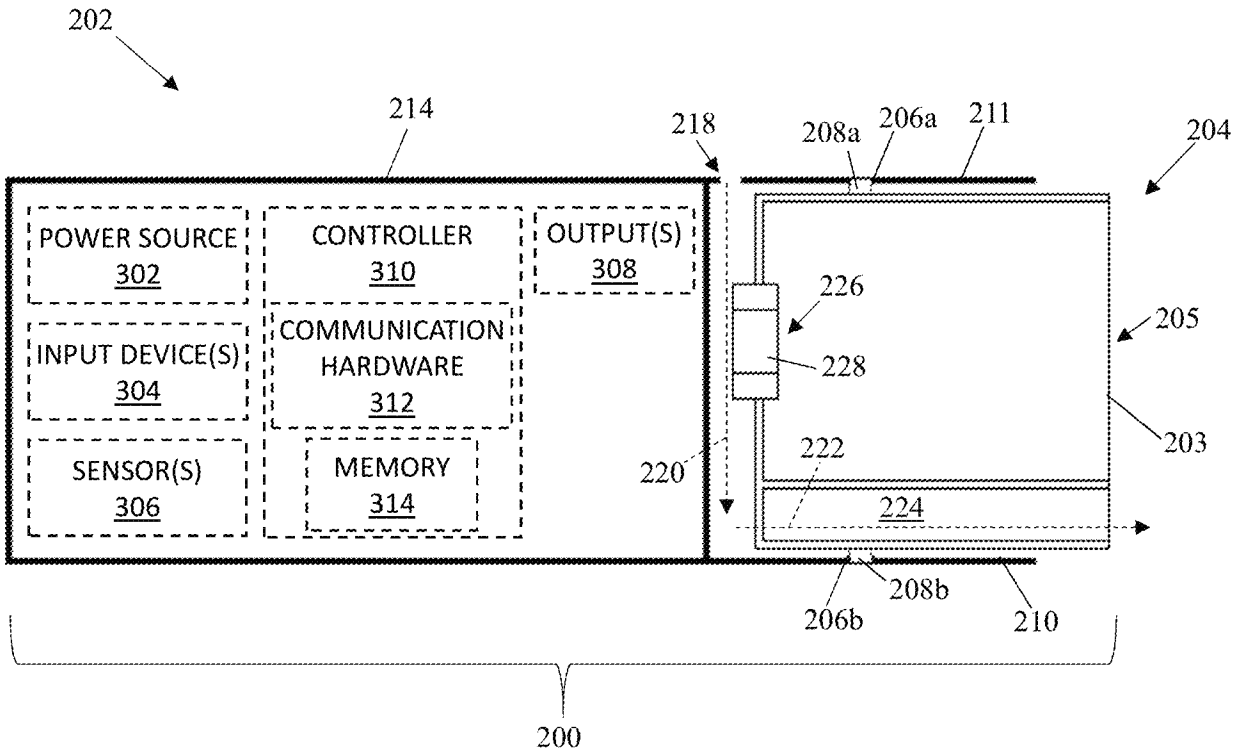
FIG. 6 is a partially transparent top view of the vaporizer device of FIG. 5, showing the vaporizer cartridge inserted into a cartridge receptacle of the vaporizer body.

Further, as shown in FIG. 1, the vaporizer cartridge 100 also includes a first set of coupling elements 132*a*, 132*b* that can be used to selectively couple the vaporizer cartridge 100 to a vaporizer body, such as vaporizer body 202 in FIGS. 5 and 6. While the first set of coupling elements 132*a*, 132*b* can have a variety of configurations, the first set of coupling elements 132*a*, 132*b*, as shown in FIG. 1, include two protrusions extending outwardly from two opposing sidewalls of the vaporizer cartridge 100.

FIGS. 5 and 6 illustrate an exemplary vaporizer device 200 that includes a vaporizer body 202 and a vaporizer cartridge 204. In FIG. 5, the vaporizer body 202 and the vaporizer cartridge 204 are illustrated in a decoupled configuration, whereas in FIG. 6, the vaporizer body 202 and the vaporizer cartridge 204 are illustrated in a coupled configuration. The vaporizer cartridge 204 is similar to vaporizer cartridge 100 in FIG. 1 and is therefore not described in detail herein. For purposes of simplicity, certain components of the vaporizer device 200 are not illustrated in FIGS. 5 and 6.

The vaporizer body 202 and the vaporizer cartridge 204 can be coupled to each other by way of corresponding coupling elements. For example, as shown in FIGS. 5 and 6, the vaporizer body 202 includes a first set of coupling elements 206*a*, 206*b*, and the vaporizer cartridge 204 includes a second set of corresponding coupling elements

208*a*, 208*b*. While the first and second set of coupling elements can have a variety of configurations, in this illustrated embodiment, the first set of coupling elements 206*a*, 206*b* include two recess pores extending inward into the vaporizer body 202 and the second set of coupling elements 208*a*, 208*b* include two protrusions extending outwardly from two opposing sidewalls 209*a*, 209*b* of the vaporizer cartridge 204.

The vaporizer body 202 can have a variety of configurations. As shown in FIGS. 5 and 6, the vaporizer body 202 includes a sleeve 210 that extends from a proximal end 210*a* to a distal end 210*b*. The sleeve 210 defines a cartridge receptacle 212 within the vaporizer body 202 that is configured to receive at least a portion of the vaporizer cartridge 204. The distal end 210*b* of the sleeve 210 is coupled to a chassis 214 that is configured to house at least a portion of additional components of the vaporizer device 200, such as, for example, any of the components discussed above (e.g., a power source, input device(s), sensor(s), output, a controller, communication hardware, memory, and the like). In this illustrated embodiment, the vaporizer device 200 includes a power source 302, input device(s) 304, sensor(s) 306, output(s) 308, a controller 310, communication hardware 312, memory 314, which, as shown in FIGS. 5 and 6, are disposed within the vaporizer body 202. Once the vaporizer cartridge 204 is coupled to the vaporizer body 202, a first airflow path 220, as shown in FIG. 6, is created within the cartridge receptacle 212 between the chassis 214 and a distal surface 204*a* of the vaporizer cartridge 204.

Further, as shown in FIGS. 5 and 6, a first air inlet 218 extends through a wall 211 of the sleeve 210. This first air inlet 218 is configured to allow at least a portion of ambient air outside of the vaporizer body 202, and thus outside of the reservoir housing 205 of the vaporizer cartridge 204, to enter the vaporizer device 200. In use, when a user puffs directly on an end 203 of the vaporizer cartridge 204, at least a portion of ambient air enters the vaporizer body 202 and travels through the first airflow path 220. Alternatively, a mouthpiece (not shown) can be coupled to the end 203 of the vaporizer cartridge 204, in which case the user can puff on the mouthpiece rather than directly on the end 203 of the vaporizer cartridge 204. As described in more detail below, vaporized material joins the first airflow path 220 and combines with at least a portion of the air to form a mixture. The mixture travels through the remaining portion of the first airflow path 220 and then through a second airflow path 222 that extends through an internal channel 224 of the vaporizer cartridge 204. As such, the first and second airflow paths 220, 222 are in fluid communication with each other.

In use, once the vaporizer cartridge 204 is coupled to the vaporizer body 202, the at least one heating material, like heating material 118 in FIG. 3, of the atomizer 226 can be activated by a user puffing on the end 203 of the vaporizer cartridge 204 and at least a portion of vaporizable material within the substrate 228 of the atomizer 226 is vaporized into vaporized material. This puffing also concurrently draws ambient air into the first airflow path through the first air inlet 218 of the sleeve 210. As a result, at least a portion of the vaporized material joins the air traveling along the first airflow path 220. Subsequently, at least a portion of the joined vaporized material and air continues to travel through the vaporizer body 202 and into the second airflow path 222 of the vaporizer cartridge 204. As the joined vaporized material and air travel through at least the second airflow path 222, and thus, the internal channel 224 of the vaporizer cartridge 204, they at least partially condense into aerosol for subsequent inhalation by a user.

Terminology

For purposes of describing and defining the present teachings, it is noted that unless indicated otherwise, the term "substantially" is utilized herein to represent the inherent degree of uncertainty that may be attributed to any quantitative comparison, value, measurement, or other representation. The term "substantially" is also utilized herein to represent the degree by which a quantitative representation may vary from a stated reference without resulting in a change in the basic function of the subject matter at issue.

When a feature or element is herein referred to as being "on" another feature or element, it can be directly on the other feature or element or intervening features and/or elements can also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements can be present. In contrast, when a feature or element is referred to as being "directly connected", "directly attached" or "directly coupled" to another feature or element, there are no intervening features or elements present.

Although described or shown with respect to one embodiment, the features and elements so described or shown can apply to other embodiments. It will also be appreciated by those of skill in the art that references to a structure or feature that is disposed "adjacent" another feature can have portions that overlap or underlie the adjacent feature.

Terminology used herein is for the purpose of describing particular embodiments and implementations only and is not intended to be limiting. For example, as used herein, the singular forms "a," "an," and "the" are intended to include the plural forms as well, unless the context clearly indicates otherwise.

In the descriptions above and in the claims, phrases such as "at least one of" or "one or more of" may occur followed by a conjunctive list of elements or features. The term "and/or" may also occur in a list of two or more elements or features. Unless otherwise implicitly or explicitly contradicted by the context in which it used, such a phrase is intended to mean any of the listed elements or features individually or any of the recited elements or features in combination with any of the other recited elements or features. For example, the phrases "at least one of A and B;" "one or more of A and B;" and "A and/or B" are each intended to mean "A alone, B alone, or A and B together." A similar interpretation is also intended for lists including three or more items. For example, the phrases "at least one of A, B, and C;" "one or more of A, B, and C;" and "A, B, and/or C" are each intended to mean "A alone, B alone, C alone, A and B together, A and C together, B and C together, or A and B and C together." Use of the term "based on," above and in the claims is intended to mean, "based at least in part on," such that an unrecited feature or element is also permissible.

Spatially relative terms, such as "forward", "rearward", "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device can be otherwise oriented (rotated 90 degrees or at other orientations) and the spatially relative descriptors used herein interpreted accordingly. Similarly, the terms "upwardly", "downwardly", "vertical", "horizontal" and the like are used herein for the purpose of explanation only unless specifically indicated otherwise.

Although the terms "first" and "second" may be used herein to describe various features/elements (including steps), these features/elements should not be limited by these terms, unless the context indicates otherwise. These terms may be used to distinguish one feature/element from another feature/element. Thus, a first feature/element discussed below could be termed a second feature/element, and similarly, a second feature/element discussed below could be termed a first feature/element without departing from the teachings provided herein.

As used herein in the specification and claims, including as used in the examples and unless otherwise expressly specified, all numbers can be read as if prefaced by the word "about" or "approximately," even if the term does not expressly appear. The phrase "about" or "approximately" may be used when describing magnitude and/or position to indicate that the value and/or position described is within a reasonable expected range of values and/or positions. For example, a numeric value can have a value that is +/−0.1% of the stated value (or range of values), +/−1% of the stated value (or range of values), +/−2% of the stated value (or range of values), +/−5% of the stated value (or range of values), +/−10% of the stated value (or range of values), etc. Any numerical values given herein should also be understood to include about or approximately that value, unless the context indicates otherwise. For example, if the value "10" is disclosed, then "about 10" is also disclosed. Any numerical range recited herein is intended to include all sub-ranges subsumed therein. It is also understood that when a value is disclosed that "less than or equal to" the value, "greater than or equal to the value" and possible ranges between values are also disclosed, as appropriately understood by the skilled artisan. For example, if the value "X" is disclosed the "less than or equal to X" as well as "greater than or equal to X" (e.g., where X is a numerical value) is also disclosed. It is also understood that the throughout the application, data is provided in a number of different formats, and that this data, represents endpoints and starting points, and ranges for any combination of the data points. For example, if a particular data point "10" and a particular data point "15" are disclosed, it is understood that greater than, greater than or equal to, less than, less than or equal to, and equal to 10 and 15 are considered disclosed as well as between 10 and 15. It is also understood that each unit between two particular units are also disclosed. For example, if 10 and 15 are disclosed, then 11, 12, 13, and 14 are also disclosed.

Although various illustrative embodiments are described above, any of a number of changes can be made to various embodiments without departing from the teachings herein. For example, the order in which various described method steps are performed may often be changed in alternative embodiments, and in other alternative embodiments, one or more method steps may be skipped altogether. Optional features of various device and system embodiments may be included in some embodiments and not in others. Therefore, the foregoing description is provided primarily for exemplary purposes and should not be interpreted to limit the scope of the claims.

One or more aspects or features of the subject matter described herein can be realized in digital electronic circuitry, integrated circuitry, specially designed application specific integrated circuits (ASICs), field programmable gate arrays (FPGAs) computer hardware, firmware, software, and/or combinations thereof. These various aspects or features can include implementation in one or more computer programs that are executable and/or interpretable on a programmable system including at least one programmable processor, which can be special or general purpose, coupled to receive data and instructions from, and to transmit data and instructions to, a storage system, at least one input device, and at least one output device. The programmable system or computing system can include clients and servers. A client and server are generally remote from each other and typically interact through a communication network. The relationship of client and server arises by virtue of computer programs running on the respective computers and having a client-server relationship to each other.

These computer programs, which can also be referred to programs, software, software applications, applications, components, or code, include machine instructions for a programmable processor, and can be implemented in a high-level procedural language, an object-oriented programming language, a functional programming language, a logical programming language, and/or in assembly/machine language. As used herein, the term "machine-readable medium" refers to any computer program product, apparatus and/or device, such as for example magnetic discs, optical disks, memory, and Programmable Logic Devices (PLDs), used to provide machine instructions and/or data to a programmable processor, including a machine-readable medium that receives machine instructions as a machine-readable signal. The term "machine-readable signal" refers to any signal used to provide machine instructions and/or data to a programmable processor. The machine-readable medium can store such machine instructions non-transitorily, such as for example as would a non-transient solid-state memory or a magnetic hard drive or any equivalent storage medium. The machine-readable medium can alternatively or additionally store such machine instructions in a transient manner, such as for example, as would a processor cache or other random access memory associated with one or more physical processor cores.

The examples and illustrations included herein show, by way of illustration and not of limitation, specific embodiments in which the subject matter may be practiced. As mentioned, other embodiments may be utilized and derived there from, such that structural and logical substitutions and changes may be made without departing from the scope of this disclosure. Such embodiments of the inventive subject matter may be referred to herein individually or collectively by the term "invention" merely for convenience and without intending to voluntarily limit the scope of this application to any single invention or inventive concept, if more than one is, in fact, disclosed. Thus, although specific embodiments have been illustrated and described herein, any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description. Use of the term "based on,"

herein and in the claims is intended to mean, "based at least in part on," such that an unrecited feature or element is also permissible.

The subject matter described herein can be embodied in systems, apparatus, methods, and/or articles depending on the desired configuration. The implementations set forth in the foregoing description do not represent all implementations consistent with the subject matter described herein. Instead, they are merely some examples consistent with aspects related to the described subject matter. Although a few variations have been described in detail herein, other modifications or additions are possible. In particular, further features and/or variations can be provided in addition to those set forth herein. For example, the implementations described herein can be directed to various combinations and subcombinations of the disclosed features and/or combinations and subcombinations of several further features disclosed herein. In addition, the logic flows depicted in the accompanying figures and/or described herein do not necessarily require the particular order shown, or sequential order, to achieve desirable results. Other implementations may be within the scope of the following claims.

What is claimed is:

1. A cartridge for a vaporizer device, the cartridge comprising:

a reservoir housing including a reservoir chamber configured to selectively hold a vaporizable material; and an atomizer in fluid communication with the reservoir chamber, the atomizer comprising:

a substrate having an array of ordered pores, the ordered pores being configured to draw a predetermined volume of vaporizable material from the reservoir chamber at a predetermined rate, and at least one heating material configured to selectively heat the at least a portion of the vaporizable material drawn into the substrate to generate a vaporized material, wherein surfaces of each of the ordered pores are plated with the at least one heating material.

2. The cartridge of claim 1, wherein the substrate is in the form of a honeycomb structure.

3. The cartridge of claim 1, wherein the substrate comprises an anodic aluminum oxide (AAO) membrane.

4. The cartridge of claim 1, wherein the at least one heating material is formed from a metal alloy.

5. The cartridge of claim 1, wherein the substrate extends from a first surface to a second surface that is opposite the first surface, and wherein at least the first surface is positioned within the reservoir chamber and a layer of the at least one heating material is disposed on the second surface.

6. The cartridge of claim 1, wherein the atomizer further includes at least one thermally insulating material disposed on at least a portion of the substrate.

7. The cartridge of claim 6, wherein the at least one thermally insulating material comprises silicon dioxide.

8. The cartridge of claim 6, wherein the at least one thermally insulating material is in the form of a tubular member having a lumen defined therein, and wherein the substrate resides within the lumen.

9. The cartridge of claim 1, wherein each pore has a diameter from about 1 nm to 1000 nm.

10. The cartridge of claim 1, wherein each pore has a length that extends from a first end to a second end, and wherein the length is between about 0 microns and 10 microns.

11. A vaporizer device, comprising:

a vaporizer body; and a cartridge that is selectively coupled to and removable from the vaporizer body, the cartridge including:

a reservoir housing including a reservoir chamber configured to selectively hold a vaporizable material; and an atomizer in fluid communication with the reservoir chamber, the atomizer comprising:

a substrate having an array of ordered pores, the ordered pores being configured to draw a predetermined volume of vaporizable material from the reservoir chamber at a predetermined rate, and at least one heating material configured to selectively heat the at least a portion of the vaporizable material drawn into the substrate to generate a vaporized material, wherein surfaces of each of the ordered pores are plated with the at least one heating material.

12. The vaporizer device of claim 11, wherein the substrate is in the form of a honeycomb structure.

13. The vaporizer device of claim 11, wherein the substrate comprises an anodic aluminum oxide (AAO) membrane.

14. The vaporizer device of claim 11, wherein the at least one heating material is formed from a metal alloy.

15. The vaporizer device of claim 11, wherein the substrate extends from a first surface to a second surface that is opposite the first surface, and wherein at least the first surface is positioned within the reservoir chamber and a layer of the at least one heating material is disposed on the second surface.

16. The vaporizer device of claim 11, wherein the atomizer further includes at least one thermally insulating material disposed on at least a portion of the substrate.

17. The vaporizer device of claim 16, wherein the at least one thermally insulating material comprises silicon dioxide.

18. The vaporizer device of claim 16, wherein the at least one thermally insulating material is in the form of a tubular member having a lumen defined therein, and wherein the substrate resides within the lumen.

19. A cartridge for a vaporizer device, the cartridge comprising:

a reservoir housing including a reservoir chamber configured to selectively hold a vaporizable material; and an atomizer in fluid communication with the reservoir chamber, the atomizer comprising:

a substrate having an array of ordered pores, the ordered pores being configured to draw a predetermined volume of vaporizable material from the reservoir chamber at a predetermined rate, and at least one heating material configured to selectively heat the at least a portion of the vaporizable material drawn into the substrate to generate a vaporized material, wherein the substrate extends from a first surface to a second surface that is opposite the first surface, and at least the first surface is positioned within the reservoir chamber; and wherein each of the ordered pores comprises a first end and a second end, and each of the ordered pores extends along a depth of the substrate such that the first end is at the first surface of the substrate and the second end is at the second surface of the substrate.

20. The cartridge of claim 19, wherein the first end of each of the ordered pores is in direct contact with the vaporizable material in the reservoir chamber.

* * * * *